US010856382B2

(12) United States Patent
Chen

(10) Patent No.: US 10,856,382 B2
(45) Date of Patent: Dec. 1, 2020

(54) ACTIVE PRELOAD FOR TRIAC DIMMERS

(71) Applicant: ERP Power LLC, Moorpark, CA (US)

(72) Inventor: Louis Chen, Simi Valley, CA (US)

(73) Assignee: ERP POWER, LLC, Moorpark, CA (US)

( * ) Notice: Subject to any disclaimer, the term of this patent is extended or adjusted under 35 U.S.C. 154(b) by 0 days.

(21) Appl. No.: 15/977,765

(22) Filed: May 11, 2018

(65) Prior Publication Data

US 2018/0332682 A1 Nov. 15, 2018

Related U.S. Application Data

(60) Provisional application No. 62/504,996, filed on May 11, 2017.

(51) Int. Cl.

| | |
|---|---|
| ***H05B 33/08*** | (2020.01) |
| ***H05B 45/14*** | (2020.01) |
| ***H05B 45/37*** | (2020.01) |
| ***H05B 47/10*** | (2020.01) |

(52) U.S. Cl.

CPC ..... *H05B 45/14* (2020.01); *H05B 45/37* (2020.01); *H05B 47/10* (2020.01)

(58) Field of Classification Search

CPC ..... H05B 33/0815; H05B 33/0824; H05B 33/0845

USPC ..... 315/205, 294

See application file for complete search history.

(56) References Cited

U.S. PATENT DOCUMENTS

| | | | | |
|---|---|---|---|---|
| 6,501,236 | B1 * | 12/2002 | Smith | H05B 39/047 315/224 |
| 6,700,333 | B1 * | 3/2004 | Hirshi | H05B 47/10 315/291 |
| 8,102,167 | B2 | 1/2012 | Irissou et al. | |
| 8,581,498 | B1 * | 11/2013 | Cheung | H05B 33/0815 315/119 |
| 8,581,518 | B2 * | 11/2013 | Kuang | H05B 45/382 315/307 |
| 8,829,819 | B1 * | 9/2014 | Angeles | H05B 45/37 315/308 |
| 8,922,129 | B1 * | 12/2014 | Rodriguez | H05B 33/0815 315/200 R |
| 2009/0243582 | A1 * | 10/2009 | Irissou | H05B 39/02 323/320 |
| 2010/0259185 | A1 * | 10/2010 | Sadwick | H03K 17/72 315/291 |
| 2011/0241557 | A1 * | 10/2011 | Grotkowski | H05B 45/10 315/246 |
| 2012/0049752 | A1 * | 3/2012 | King | H05B 45/3575 315/210 |
| 2012/0299500 | A1 | 11/2012 | Sadwick et al. | |
| 2014/0126261 | A1 * | 5/2014 | Newman, Jr. | H02M 5/293 363/128 |

(Continued)

OTHER PUBLICATIONS

International Search Report and Written Opinion issued in corresponding PCT Application No. PCT/US18/32377; dated Sep. 19, 2018, 11 pages.

*Primary Examiner* — Tung X Le

(74) *Attorney, Agent, or Firm* — Lewis Roca Rothgerber Christie LLP

(57) ABSTRACT

An active preload circuit includes: a rectifier configured to receive an AC input from a TRIAC dimmer and to generate DC power; a preload; and a phase angle controller configured to selectively couple the preload to the DC power.

20 Claims, 3 Drawing Sheets

(56) References Cited

U.S. PATENT DOCUMENTS

| | | | | |
|---|---|---|---|---|
| 2014/0159616 | A1 | 6/2014 | Wang et al. | |
| 2014/0239849 | A1* | 8/2014 | Del Carmen, Jr. | H05B 33/0815 315/307 |
| 2015/0137704 | A1* | 5/2015 | Angeles | H05B 33/0815 315/297 |
| 2015/0163873 | A1 | 6/2015 | Kawai et al. | |
| 2015/0180354 | A1 | 6/2015 | Sadwick et al. | |
| 2017/0150569 | A1* | 5/2017 | Hayashi | H05B 39/048 |

* cited by examiner

ACTIVE PRELOAD FOR TRIAC DIMMERS

CROSS-REFERENCE TO RELATED APPLICATIONS

This utility patent application claims priority to and the benefit of U.S. Provisional Application No. 62/504,996 filed on May 11, 2017, entitled Active Preload For Triac Dimmers, the entire contents of which is incorporated herein by reference.

FIELD

One or more aspects of embodiments according to the present invention relate to triode for alternating current (TRIAC) dimmable light-emitting diode (LED) drivers.

BACKGROUND

Triode for alternating current (TRIAC) dimmers are phase-controlled dimmers that are being widely used for lighting applications, such as for dimmable driving of incandescent and halogen lights. Because TRIAC dimmers have been designed for resistive loads, they are generally not compatible with light-emitting diode (LED) lights because LEDs do not typically have suitable resistive load characteristics. As such, because some TRIAC dimmers require minimum load to operate properly, when these TRIAC dimmers are used to drive LED lights, undesirable flickering or shimmering of lights may be generated when dimming.

To solve this problem, some LED drivers add a series resistor in the power train and some are adding an external power resistor to the TRIAC dimmer for preload to maintain good light quality and prevent light output from flickering or shimmering. However, such preload may require power dissipation at nominal AC input and therefore may not be energy efficient.

SUMMARY

According to example embodiments of the present invention, an active preload circuit is provided for used with triode for alternating current (TRIAC) dimmers. For example, the active preload circuit will not dissipate any power or reduce the dissipation of power when running nominal AC input to maintain higher efficiency. Further, the active preload circuit according to embodiments of the present invention may only activate at lower dimming angle which can be adjusted.

Hence, example embodiments according to the present invention may be used in all dimmable light-emitting diode (LED) lighting with TRIAC dimmers. By replacing ordinary preload with the active preload circuit according to example embodiments of the present invention, power dissipation may be reduced or eliminated and may become more energy efficient when running nominal AC input.

The active preload circuit according to example embodiments of the present invention may result in an improvement to quality of light and/or maintaining good quality of light for all TRIAC dimmable LED drivers while saving energy at the same time. Further, the active preload circuit according to example embodiments of the present invention may maintain high efficiency at nominal AC input voltage and/or high dimming angle. By applying the active preload circuit according to example embodiments of the present invention, low cost dimmers may be used to get good quality light without flickering or shimmering.

The active preload circuit according to example embodiments of the present invention may be implemented in a new LED driver, or may be coupled to an existing LED driver (for example, by implementing the active preload circuit as a dongle).

According to an embodiment of the present invention, active preload circuit includes: a rectifier configured to receive an AC input from a TRIAC dimmer and to generate DC power; a preload; and a phase angle controller configured to selectively couple the preload to the DC power.

BRIEF DESCRIPTION OF THE DRAWINGS

These and other features and aspects of the present invention will be appreciated and understood with reference to the specification, claims, and appended drawings wherein:

DETAILED DESCRIPTION

Aspects of embodiments according to the present invention relate to an active preload circuit for use with a triode for alternating current (TRIAC) dimmer to drive light-emitting diode (LED) lights.

The detailed description set forth below in connection with the appended drawings is intended as a description of exemplary embodiments of the present invention provided in accordance with the present invention and is not intended to represent the only forms in which the present invention may be constructed or utilized. The description sets forth the features of the present invention in connection with the illustrated embodiments. It is to be understood, however, that the same or equivalent functions and structures may be accomplished by different embodiments that are also intended to be encompassed within the spirit and scope of the invention. As denoted elsewhere herein, like element numbers are intended to indicate like elements or features.

Figure 1:
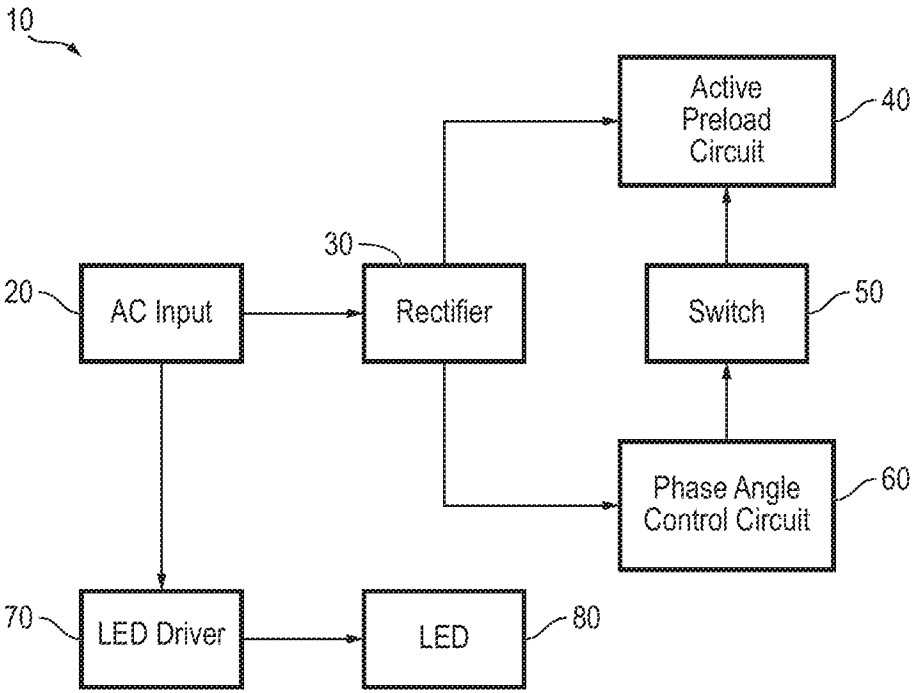
FIG. 1 is a schematic block diagram illustrating an operation of an active preload circuit and LED light according to one or more example embodiments of the present invention.

FIG. 1 is a schematic block diagram illustrating an operation of an active preload circuit used in a driver system 10 according to one or more example embodiments of the present invention.

As can be seen in FIG. 1, an active preload 40 is coupled to a rectifier 30, and a switch 50. A phase angle control circuit 60 is also coupled to the rectifier 30 and the switch 50. The rectifier 30 receives and rectifies an AC input 20 to generate DC power that it provides to the active preload 40 and the phase angle control circuit 60. The active preload 40 operates with a TRIAC dimmer to control an LED light in a dimmable manner.

Further, LED driver 70 receives the AC input in parallel to the rectifier 30. The LED driver 70 drives the LED 80 based on the received AC input.

According to some embodiments of the present invention, the AC input 20 is provided from a TRIAC dimmer.

Figure 2:
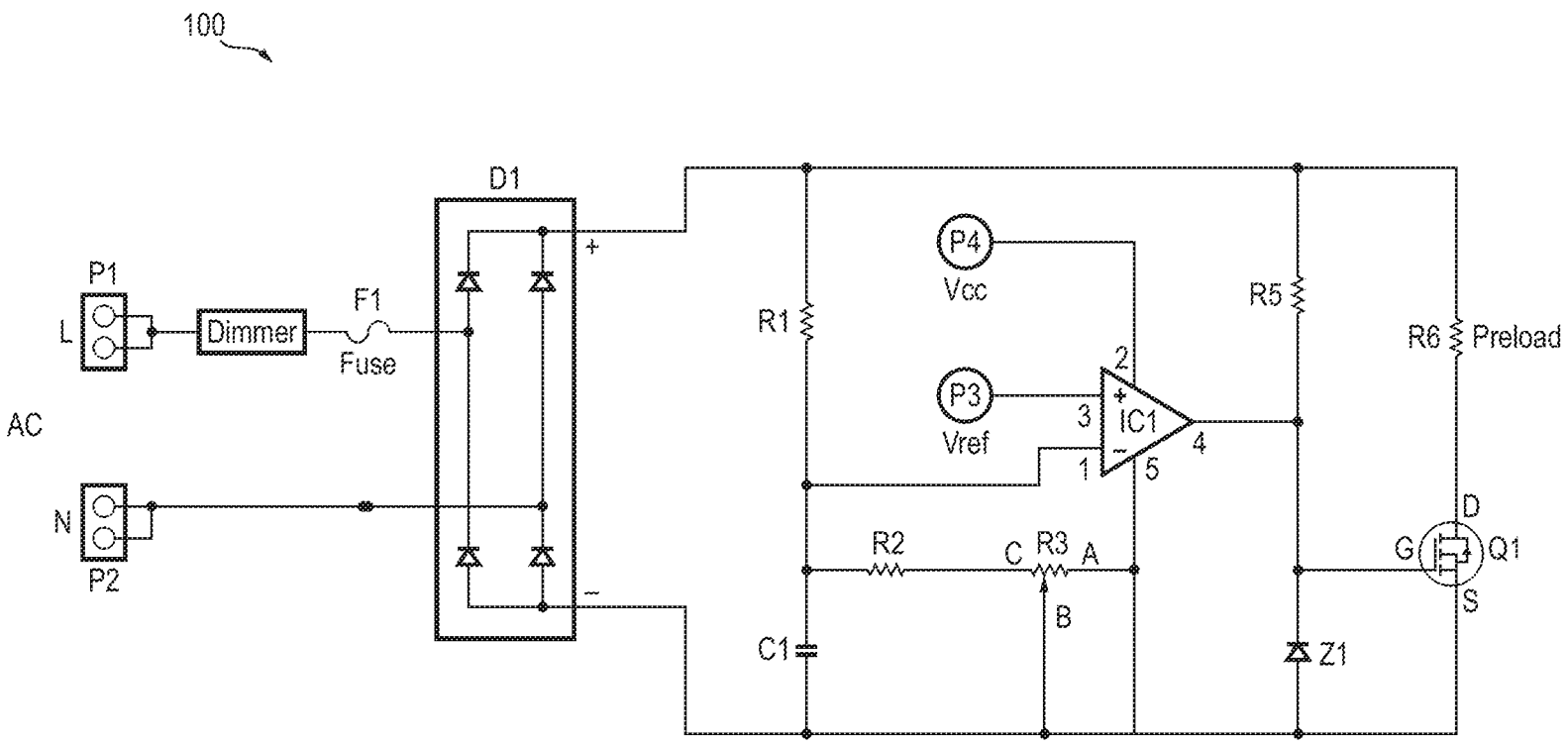
FIG. 2 is a schematic circuit diagram of an active preload circuit according to one or more example embodiments of the present invention.

FIG. 2 is a schematic circuit diagram of an active preload circuit 100 according to one or more example embodiments of the present invention.

As can be seen in FIG. 2, an AC input is applied at points (or terminals) P1 and P2. A rectifier D1 receives the AC input, and rectifies it to generate DC power. A phase angle control circuit 60 is provided using resistors R1, R2, R3, R5, a capacitor C1, a Zener diode Z1, and a phase angle controller IC1 (e.g., an operational amplifier). The active preload circuit 100 also includes a switch Q1 and a preload R6.

According to one or more example embodiments of the present invention, P1 is a line input and P2 is a neutral input. The line input is supplied to the TRIAC dimmer via the terminal P1. The load output of the TRIAC dimmer is connected to both the rectifier D1 and the LED driver (See FIG. 1). A fuse F1 may be present between the TRIAC dimmer and the rectifier D1. The rectifier D1 may be directly connected to neutral (e.g., ground) via the terminal P2.

The rectifier D1 rectifies an AC phase cut signal received from the TRIAC dimmer and provides a rectified signal (e.g., DC power) to the phase angle controller IC1 through a timing control network including the resistors R1, R2, R3 and the capacitor C1.

The resistor R1 may be connected between a positive output terminal of the rectifier D1 and Pin 1 of the phase angle controller IC1. The capacitor C1 may be connected between a negative output terminal of the rectifier D1 and Pin 1 of the phase angle controller IC1. The resistors R2 and R3 may be connected in series between Pin 1 of the phase angle controller IC1 and Pin 5 of the phase angle controller IC1. The resistor R3 may be a potentiometer with the third terminal connected to the negative output of the rectifier D1. The resistor R5 may be connected between Pin 4 (e.g., output) of the phase angle controller IC1 and the positive terminal of the rectifier D1. The resistor R6 (e.g., the preload) may be connected between a drain of the switch Q1 and the positive terminal of the rectifier D1.

A gate of the switch Q1 may be connected to Pin 4 of the phase angle controller IC1 and a source of the switch Q1 may be connected to the negative terminal of the rectifier D1. The Zener diode Z1 may be connected between the negative terminal of the rectifier D1 and Pin 4 of the phase angle controller IC1. Pin 5 of the phase angle controller IC1 may be connected to the negative output of the rectifier D1. The phase angle controller may further receive a power voltage Vcc at Pin 2.

In one or more example embodiments, Pin 4 (e.g., output) of the phase angle controller IC1 may be high when the phase angle of the voltage received from the TRIAC dimmer is low, e.g., every time an input voltage at an inverted input (i.e., Pin 1) is lower than a reference voltage Vref P3 provided to an input (i.e., Pin 3), and turn on the R6 preload switch Q1. The resistor R5 and the Zener diode provide a bias voltage for the switch Q1. On the other hand, Pin 4 (e.g., output) of the phase angle controller IC1 will be low when the phase angle is high enough that the inverted input (i.e., Pin 1) is higher than the reference voltage Vref P3 provided to the input (i.e., Pin 3), and turn off the R6 preload switch Q1.

In some embodiments, the level of the reference voltage Vref provided to the input (i.e., Pin 3) of the phase angle controller IC1 may be configurable (e.g., adjustable by an end user or an installer) to adjust the triac phase angle at which the active preload is coupled to the AC input.

In some embodiments, the resistor R3 is a potentiometer or variable resistor. The end terminals of the resistor R3 are coupled between the resistor R2 and the negative terminal of the rectifier D1, and the wiper terminal is coupled to the negative terminal of the rectifier D1. The position of the wiper may be configurable (e.g., adjustable by an end user or an installer) to adjust the triac phase angle at which the active preload is coupled to the AC input.

Figure 3:
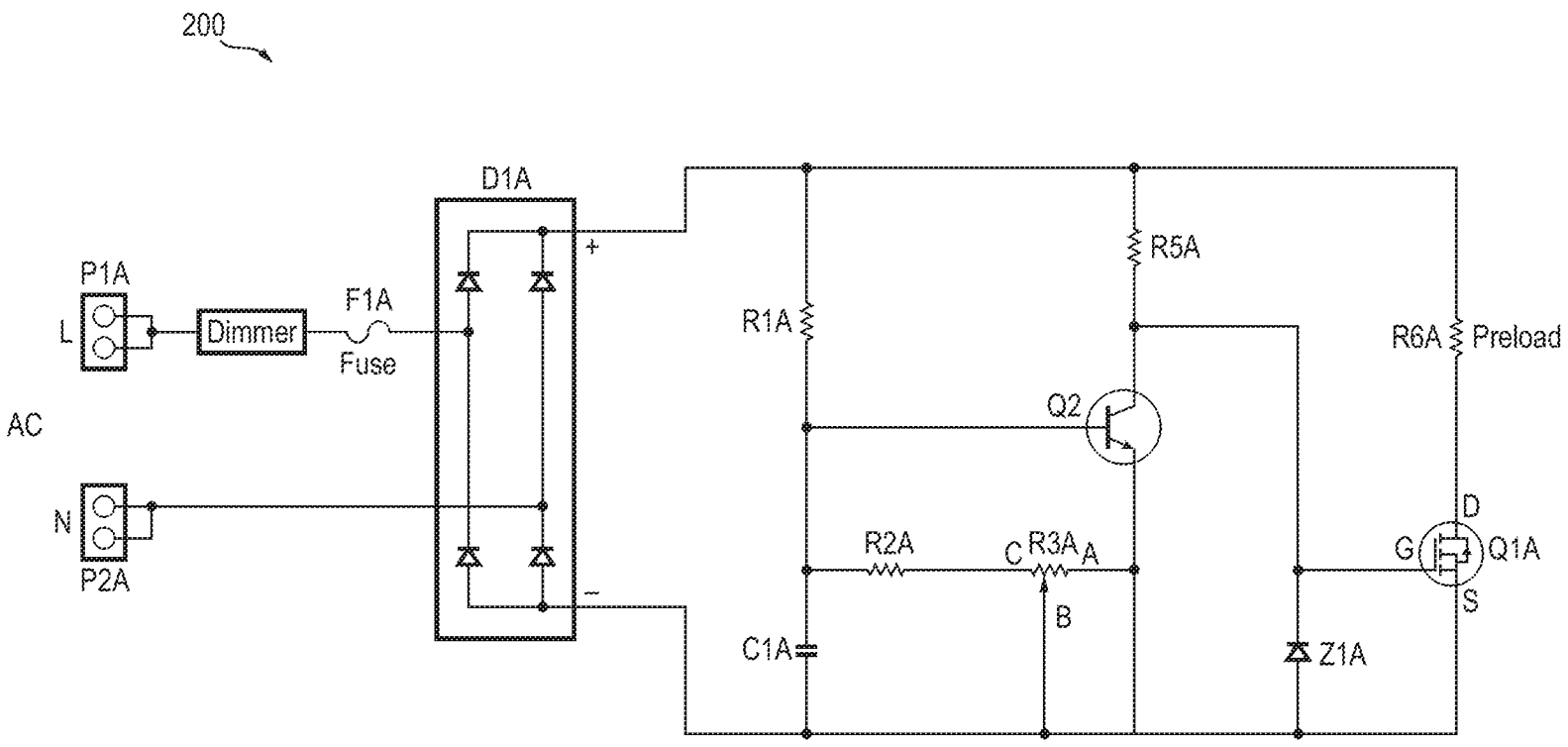
FIG. 3 is a schematic circuit diagram of an active preload circuit according to one or more example embodiments of the present invention.

FIG. 3 is a schematic circuit diagram of an active preload circuit 200 according to one or more example embodiments of the present invention.

The active preload circuit 200 of FIG. 3 is substantially similar to the active preload circuit 100 of FIG. 2, except that the phase angle controller IC1 of FIG. 2 has been replaced in FIG. 3 by an NPN bipolar transistor Q2. In other embodiments, any other suitable transistor may be used instead of or in addition to the NPN bipolar transistor Q2.

In the NPN bipolar transistor Q2, as compared to the phase angle controller IC1 of FIG. 2, a gate of the NPN bipolar transistor Q2 has substantially the same connections as Pin 1 of the phase angle controller IC1 of FIG. 2, the source has substantially the same connections as Pin 4 of the phase angle controller IC1 of FIG. 2, and the drain has substantially the same connections as Pin 5 of the phase angle controller IC1 of FIG. 2.

The NPN bipolar transistor Q2 may not have connections similar to those of Pins 2 and 3 of the phase angle controller IC1 of FIG. 2.

A relevant device or component (or relevant devices or components) according to embodiments of the present invention described herein may be implemented utilizing any suitable hardware (e.g., an application-specific integrated circuit), firmware (e.g., a DSP or FPGA), software, or a suitable combination of software, firmware, and hardware. For example, the various components of the relevant device(s) may be formed on one integrated circuit (IC) chip or on separate IC chips. Further, the various components of the relevant device(s) may be implemented on a flexible printed circuit film, a tape carrier package (TCP), a printed circuit board (PCB), or formed on a same substrate as one or more circuits and/or other devices. Further, the various components of the relevant device(s) may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Further, it will also be understood that when one element, component, region, layer, and/or section is referred to as being "between" two elements, components, regions, layers, and/or sections, it can be the only element, component, region, layer, and/or section between the two elements, components, regions, layers, and/or sections, or one or more intervening elements, components, regions, layers, and/or sections may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprise," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," "one of," and "selected from," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

As used herein, the terms "use," "using," and "used" may be considered synonymous with the terms "utilize," "utilizing," and "utilized," respectively.

Features described in relation to one or more embodiments of the present invention are available for use in conjunction with features of other embodiments of the present invention. For example, features described in a first embodiment may be combined with features described in a second embodiment to form a third embodiment, even though the third embodiment may not be specifically described herein.

A person of skill in the art should also recognize that the process may be executed via hardware, firmware (e.g., via an ASIC), or in any combination of software, firmware, and/or hardware. Furthermore, the sequence of steps of the process is not fixed, but can be altered into any desired sequence as recognized by a person of skill in the art. The altered sequence may include all of the steps or a portion of the steps.

Although this invention has been described with regard to certain specific embodiments, those skilled in the art will have no difficulty devising variations of the described embodiments, which in no way depart from the scope and spirit of the present invention. Furthermore, to those skilled in the various arts, the invention itself described herein will suggest solutions to other tasks and adaptations for other applications. It is the Applicant's intention to cover by claims all such uses of the invention and those changes and modifications which could be made to the embodiments of the invention herein chosen for the purpose of disclosure without departing from the spirit and scope of the invention. Thus, the present embodiments of the invention should be considered in all respects as illustrative and not restrictive, the scope of the invention to be indicated by the appended claims and their equivalents.

What is claimed is:

1. An active preload circuit comprising:

a rectifier configured to receive an AC input from a triode for alternating current (TRIAC) dimmer and to generate DC power;

a preload; and a phase angle control circuit configured to selectively couple the preload to the DC power, via a switch, when a phase angle of the AC input is below a level, the phase angle control circuit comprising:

a first resistor, a second resistor, and a third resistor coupled together between a positive terminal and a negative terminal of the rectifier, the third resistor being a variable resistor configured to adjust the level at which the phase angle control circuit couples the preload to the DC power;

a zener diode coupled between a gate of the switch and a negative terminal of the rectifier;

a bipolar transistor having a source coupled to the zener diode; and a fourth resistor coupled between the source of the bipolar transistor and a positive terminal of the rectifier.

2. The active preload circuit of claim 1, wherein the phase angle control circuit comprises:

a first resistor coupled between a positive terminal of the rectifier and a gate of the bipolar transistor;

a second resistor coupled between the gate of the bipolar transistor and a third resistor;

the third resistor coupled between the second resistor and a negative terminal of the rectifier, the third resistor being the variable resistor; and a capacitor coupled between the gate of the bipolar transistor and the negative terminal of the rectifier, wherein the switch is coupled between a terminal of the preload and the negative terminal of the rectifier, the gate of the switch being coupled to the source of the bipolar transistor, the preload being coupled between the switch and the positive terminal of the rectifier, a drain of the bipolar transistor being coupled to the negative terminal of the rectifier, and wherein the zener diode is coupled between a source of the bipolar transistor and the negative terminal of the rectifier.

3. The active preload circuit of claim 2, wherein a wiper terminal of the third resistor is coupled to the negative terminal of the rectifier.

4. The active preload circuit of claim 3, wherein a position of a wiper of the third resistor is configured to be adjustable.

5. The active preload circuit of claim 1, wherein the preload is a resistive load.

6. An active preload circuit comprising:

a rectifier configured to receive an AC input from a triode for alternating current (TRIAC) dimmer and to generate DC power;

a preload; and a phase angle control circuit configured to selectively couple the preload to the DC power when a phase angle of the AC input is below a level, wherein the phase angle control circuit comprises:

an operational amplifier;

a first resistor coupled between a positive terminal of the rectifier and an inverting input of the operational amplifier;

a reference voltage coupled to a non-inverting input of the operational amplifier;

a supply voltage coupled to a positive supply voltage input of the operational amplifier;

a second resistor coupled between the inverting input of the operational amplifier and a third resistor;

the third resistor coupled between the second resistor and a negative terminal of the rectifier, the third resistor being a variable resistor;

a capacitor coupled between the inverting input of the operational amplifier and the negative terminal of the rectifier;

a zener diode coupled between an output of the operational amplifier and the negative terminal of the rectifier;

a fourth resistor coupled between the output of the operational amplifier and the positive terminal of the rectifier; and a switch coupled between a terminal of the preload and the negative terminal of the rectifier, a gate of the switch being coupled to the output of the operational amplifier, the preload being coupled between the switch and the positive terminal of the rectifier.

7. The active preload circuit of claim 6, wherein the reference voltage is configured to be adjustable.

8. The active preload circuit of claim 6, wherein a wiper terminal of the third resistor is coupled to the negative terminal of the rectifier.

9. The active preload circuit of claim 8, wherein a position of a wiper of the third resistor is configured to be adjustable.

10. An LED lighting system comprising:

a phase cut AC input;

an LED driver configured to receive an AC phase cut signal from the phase cut AC input and to generate a DC supply voltage to provide a driving current to an LED lamp; and an active preload circuit comprising a rectifier and being configured to receive the AC phase cut signal from the phase cut AC input and to selectively couple a preload to the phase cut AC input, via a switch, when a phase angle of the phase cut AC input is below a level, the active preload circuit comprising:

a first resistor, a second resistor, and a third resistor coupled together between a positive terminal and a negative terminal of the rectifier, the third resistor being a variable resistor configured to adjust the level at which the active preload circuit couples the preload to the phase cut AC input;

a zener diode coupled between a gate of the switch and a negative terminal of the rectifier;

an operational amplifier having an output coupled to the zener diode; and a fourth resistor coupled between the output of the operational amplifier and a positive terminal of the rectifier.

11. The LED lighting system of claim 10, further comprising a TRIAC dimmer, wherein the TRIAC dimmer receives an AC input and generates the AC phase cut signal at the phase cut AC input.

12. The LED lighting system of claim 10, wherein the active preload circuit comprises the switch, the preload, and a phase angle control circuit configured to couple the preload to the phase cut AC input by controlling the switch.

13. The LED lighting system of claim 12, wherein the phase angle control circuit comprises:

a first resistor coupled between a positive terminal of the rectifier and an inverting input of the operational amplifier;

a reference voltage coupled to a non-inverting input of the operational amplifier;

a supply voltage coupled to a positive supply voltage input of the operational amplifier;

a second resistor coupled between the inverting input of the operational amplifier and a third resistor;

the third resistor coupled between the second resistor and a negative terminal of the rectifier, the third resistor being the variable resistor;

a capacitor coupled between the inverting input of the operational amplifier and the negative terminal of the rectifier;

wherein the switch is coupled between a terminal of the preload and the negative terminal of the rectifier, a gate of the switch being coupled to the output of the operational amplifier, the preload being coupled between the switch and the positive terminal of the rectifier, and wherein the zener diode is coupled between an output of the operational amplifier and the negative terminal of the rectifier.

14. The LED lighting system of claim 13, wherein the reference voltage is configured to be adjustable.

15. The LED lighting system of claim 13, wherein a wiper terminal of the third resistor is coupled to the negative terminal of the rectifier.

16. The LED lighting system of claim 15, wherein a position of a wiper of the third resistor is configured to be adjustable.

17. The LED lighting system of claim 10, wherein the preload is a resistive load.

18. An LED lighting system comprising:

a phase cut AC input;

an LED driver configured to receive an AC phase cut signal from the phase cut AC input and to generate a DC supply voltage to provide a driving current to an LED lamp; and an active preload circuit comprising a rectifier and being configured to receive the AC phase cut signal from the phase cut AC input and to selectively couple a preload to the phase cut AC input, via a switch, when a phase angle of the phase cut AC input is below a level, the active preload circuit comprising:

a variable resistor configured to adjust the level at which the active preload circuit couples the preload to the phase cut AC input; and a zener diode coupled between a gate of the switch and a negative terminal of the rectifier, wherein the active preload circuit comprises the switch, the preload, and a phase angle control circuit configured to couple the preload to the phase cut AC input by controlling the switch, and wherein the phase angle control circuit comprises:

a bipolar transistor;

a first resistor coupled between a positive terminal of the rectifier and a gate of the bipolar transistor;

a second resistor coupled between the gate of the bipolar transistor and a third resistor;

the third resistor coupled between the second resistor and a negative terminal of the rectifier, the third resistor being the variable resistor;

a capacitor coupled between the gate of the bipolar transistor and the negative terminal of the rectifier; and a fourth resistor coupled between a source of the bipolar transistor and the positive terminal of the rectifier;

wherein the switch is coupled between a terminal of the preload and the negative terminal of the rectifier, a gate of the switch being coupled to the source of the bipolar transistor, the preload being coupled between the switch and the positive terminal of the rectifier, a drain of the bipolar transistor being coupled to the negative terminal of the rectifier, and wherein the zener diode is coupled between a source of the bipolar transistor and the negative terminal of the rectifier.

19. The LED lighting system of claim 18, wherein a wiper terminal of the third resistor is coupled to the negative terminal of the rectifier.

20. The LED lighting system of claim 19, wherein a position of a wiper of the third resistor is configured to be adjustable.

* * * * *